US006557634B2

(12) United States Patent
Hailey, Jr. et al.

(10) Patent No.: US 6,557,634 B2
(45) Date of Patent: May 6, 2003

(54) APPARATUS AND METHOD FOR GRAVEL PACKING AN INTERVAL OF A WELLBORE

(75) Inventors: Travis T. Hailey, Jr., Sugarland, TX (US); William David Henderson, Tioga, TX (US); Stephen Lee Crow, Kingswood, TX (US); Philip D. Nguyen, Duncan, OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 134 days.

(21) Appl. No.: 09/800,199

(22) Filed: Mar. 6, 2001

(65) Prior Publication Data

US 2002/0125006 A1 Sep. 12, 2002

(51) Int. Cl.[7] ..... E21B 43/04
(52) U.S. Cl. ..... 166/278; 166/51
(58) Field of Search ..... 166/278, 51, 276, 166/227, 228

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,165,476 A | * | 11/1992 | Jones | 166/227 |
| 5,333,688 A | | 8/1994 | Jones et al. | 166/278 |
| 5,355,956 A | | 10/1994 | Restarick | 166/296 |
| 5,390,966 A | | 2/1995 | Cox et al. | 285/137.1 |
| 5,419,394 A | | 5/1995 | Jones | 166/51 |
| 5,443,117 A | | 8/1995 | Ross | 166/51 |
| 5,476,143 A | | 12/1995 | Sparlin et al. | 166/233 |
| 5,515,915 A | | 5/1996 | Jones et al. | 166/51 |
| 5,588,487 A | | 12/1996 | Bryant | 166/51 |
| 5,636,691 A | | 6/1997 | Hendrickson et al. | 166/278 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Frac Pack Technology Still Evolving," Charles D. Ebinger of Ely & Associates Inc.; Oil & Gas Journal, Oct. 23, 1995.

(List continued on next page.)

*Primary Examiner*—David Bagnell
*Assistant Examiner*—Jennifer R. Dougherty
(74) *Attorney, Agent, or Firm*—Lawrence R. Youst

(57) ABSTRACT

An apparatus and method for gravel packing an interval of a wellbore is disclosed. The apparatus comprises an outer tubular (110) forming a first annulus with the wellbore and an inner tubular (114) disposed within the outer tubular (110) forming a second annulus therebetween. The second annulus includes an axially extending slurry passageway (194) and an axially extending production pathway (190). The portion of the outer tubular (110) adjacent the slurry passageway (194) has an outlet (128). The portion of both the outer and inner tubulars (110, 114) adjacent the production pathway (190) has a plurality of openings (122, 146). The slurry passageway (194) is in fluid isolation from the production pathway (190) such that when a fluid slurry containing gravel is injected through the slurry passageway (194), the fluid slurry exits through the outlet (128) leaving gravel in the first annulus, thereby gravel packing the interval.

106 Claims, 9 Drawing Sheets

U.S. PATENT DOCUMENTS

| | | | | |
|---|---|---|---|---|
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |

OTHER PUBLICATIONS

"Mechanical Fluid–Loss Control Systems Used During Sand Control Operations," H.L. Restarick of Otis Engineering Corp., 1992.

"Sand Control Screens," Halliburton Energy Services, 1994.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc., Society of Petroleum Engineers Inc., Feb., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"CAPS$^{SM}$ Concentric Annular Packing Service for Sand Control," 2000 Halliburton Energy Services, Inc., Aug., 2000.

"CAPS$^{SM}$ Sand Control Service for Horizontal Completions Improves Gravel Pack Reliability and Increases Production Potential from Horizontal Completions," 2000 Halliburton Energy Services, Inc., Aug. 2000.

* cited by examiner

APPARATUS AND METHOD FOR GRAVEL PACKING AN INTERVAL OF A WELLBORE

TECHNICAL FIELD OF THE INVENTION

This invention relates in general to preventing the production of particulate materials through a wellbore traversing an unconsolidated or loosely consolidated subterranean formation and, in particular to, an apparatus and method for obtaining a substantially complete gravel pack within an interval of the wellbore.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a workstring to a position proximate the desired production interval. A fluid slurry including a liquid carrier and a particulate material known as gravel is then pumped down the workstring and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulates carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge. It has been found, however, that shunt tubes installed on the exterior of sand control screens are susceptible to damage during installation. In addition, it has been found, that it is difficult and time consuming to make all of the necessary fluid connections between the numerous joints of shunt tubes required for typical production intervals.

Therefore a need has arisen for an apparatus and method for gravel packing a production interval traversed by a wellbore that overcomes the problems created by sand bridges. A need has also arisen for such an apparatus that is not susceptible to damage during installation. Further, a need has arisen for such an apparatus that is not difficult or time consuming to assemble.

SUMMARY OF THE INVENTION

The present invention disclosed herein comprises an apparatus and method for gravel packing a production interval of a wellbore that traverses an unconsolidated or loosely consolidated formation that overcomes the problems created by the development of a sand bridge between a sand control screen and the wellbore. Importantly, the apparatus of the present invention is not susceptible to damage during installation and is not difficult or time consuming to assemble.

The apparatus for gravel packing an interval of a wellbore of the present invention comprises an outer tubular forming a first annulus with the wellbore and an inner tubular disposed within the outer tubular forming a second annulus therebetween. Typically, the inner tubular is positioned around a sand control screen. Together, the sand control screen and the apparatus of the present invention are assembled at the surface and run downhole to a location proximate the production interval. A portion of the side wall of the outer tubular is an axially extending production section that includes a plurality of openings. Another portion of the side wall of the outer tubular is an axially extending nonproduction section that includes one or more outlets. Similarly, a portion of the side wall of the inner tubular is an axially extending production section that is substantially circumferentially aligned with the production section of the outer tubular. Another portion of the side wall of the inner tubular is an axially extending nonproduction section that is substantially radially aligned with the nonproduction section of the outer tubular. The production section of the inner tubular has a plurality of openings therethrough, but the nonproduction section of the inner tubular has no openings therethrough.

The volume within the second annulus between the nonproduction sections of the outer and inner tubulars is an axially extending slurry passageway. The volume within the second-annulus between the production sections of the outer and inner tubulars is an axially extending production pathway. An isolation member, which is disposed within the second annulus, defines the circumferential boundaries of the production pathway and the slurry passageway and prevents fluid communication between the production pathway and the slurry passageway. The isolation member also defines the axial boundaries of the production pathway. As such, when a fluid slurry containing gravel is injected through the slurry passageway, the fluid slurry exits the slurry passageway through the outlet leaving a first portion of the gravel in the first annulus. Thereafter, the fluid slurry enters the openings in the outer tubular leaving a second portion of the gravel in the production pathway. Thus, when formation fluids are produced, the formation fluids travel radially through the production pathway by entering the production pathway through the openings in the outer tubular and exiting the production pathway through the openings in the inner tubular. The formation fluids pass through the first portion of the gravel in the first annulus prior to entry into the production pathway and the second portion of the gravel in the production pathway which filters out any particulate materials in the formation fluids. Formation fluids are prevented, however, from traveling radially through the slurry passageway as there are no openings in the nonproduction section of the inner tubular.

More specifically, the isolation member disposed within the second annulus may have a pair of substantially parallel, circumferentially spaced apart, axially extending members that radially extend between the outer and inner tubulars and a pair of substantially parallel, axially spaced apart, circumferentially extending members that radially extend between the outer and inner tubulars that define the production pathway and the slurry passageway and prevent fluid communication therebetween.

In one embodiment of the present invention, an actuatable device may be disposed within each of the outlets to selectively allow and prevent the fluid slurry from flowing therethrough. The actuatable devices may, for example, be pressure actuated devices, electrically actuated devices, acoustically actuated devices or the like. Suitable actuatable devices may include rupture disks or valves, such as one way valves.

Alternatively, the outlets may each have an exit tube disposed therein. The exit tubes may, for example, be positioned partially within the second annulus, partially within the first annulus or both. As yet another alternative, an insert member may be disposed at least partially within each of the outlets to prevent erosion of the outlets.

In embodiments of the present invention that have more than one outlet, the outlets may have various sizes and shapes. In addition, certain embodiments of the present invention may include multiple production pathways and multiple slurry passageways. In such embodiments, the outlets of the various slurry passageways may be at different axial positions along the outer tubular.

Commonly, more than one such apparatus for gravel packing an interval of a wellbore must be coupled together to achieve a length sufficient to gravel pack an entire production interval. In such cases, multiple sections of the apparatus of the present invention are coupled together, for example, via a threaded connection. Also, in such cases, the slurry passageways of the various sections are in fluid communication with one another allowing an injected fluid slurry to flow from one such apparatus to the next, while the production pathways of the various sections are in fluid isolation from one another.

In a method for gravel packing an interval of a wellbore of the present invention, the method comprises providing a wellbore that traverses a formation, either open hole or cased, perforating the casing, in the cased hole embodiment, proximate the formation to form a plurality of perforations, locating a sand control screen within the wellbore proximate the formation, positioning the gravel packing apparatus around the sand control screen to form a first annulus between the gravel packing apparatus and the wellbore, injecting a fluid slurry containing gravel through the slurry passageway such that the fluid slurry exits through the outlets into the first annulus, depositing a first portion of the gravel in the first annulus, depositing a second portion of the gravel in the production pathway by injecting a portion of the fluid slurry through openings in the outer tubular and terminating the injection when the first annulus and the production pathway are substantially completely packed with gravel. In addition to injecting the fluid slurry containing gravel through the slurry passageway, in some embodiments, the fluid slurry may also be injected down the first annulus.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
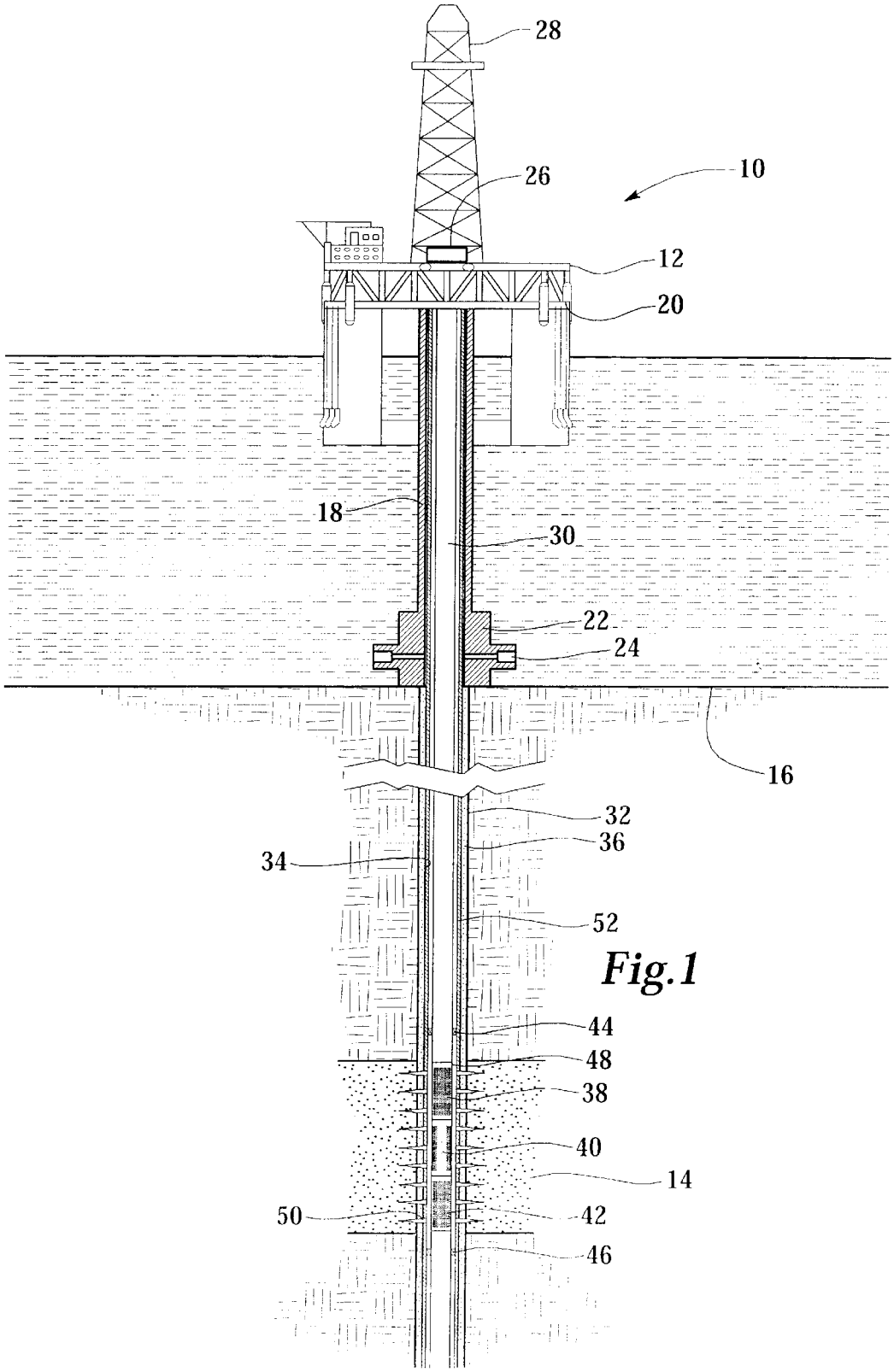
FIG. 1 is a schematic illustration of an offshore oil and gas platform operating an apparatus for gravel packing an interval of a wellbore of the present invention.

Referring initially to FIG. 1, several apparatuses for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 include various tools including apparatuses 38, 40, 42 for gravel packing an interval of wellbore 32 adjacent to formation 14 between packers 44, 46 and into annular region 48. When it is desired to gravel pack annular region 48, work string 30 is lowered through casing 34 until apparatuses 38, 40, 42 are positioned adjacent to formation 14 including perforations 50. Thereafter, a fluid slurry including a liquid carrier and a particulate material such as gravel is pumped down workstring 30.

As explained in more detail below, the fluid slurry may be injected entirely into apparatus 38 and sequentially flow through apparatuses 40, 42. During this process, portions of the fluid slurry exit each apparatus 38, 40, 42 such that the fluid slurry enters annular region 48. Once in annular region 48, a portion the gravel in the fluid slurry is deposited therein. Some of the liquid carrier may enter formation 14 through perforation 50 while the remainder of the fluid carrier, along with some of the gravel, reenters certain sections of apparatuses 38, 40, 42 depositing gravel in those sections. As a sand control screen (not pictured) is positioned within apparatuses 38, 40, 42, the gravel remaining in the fluid slurry is disallowed from further migration. The liquid carrier, however, can travel through the sand control screen, into workstring 30 and up to the surface in a known manner, such as through a wash pipe and into the annulus 52 above packer 44. The fluid slurry is pumped down workstring 30 through apparatuses 38, 40, 42 until annular section 48 surrounding apparatuses 38, 40, 42 and portions of apparatuses 38, 40, 42 are filled with gravel.

Alternatively, instead of injecting the entire stream of fluid slurry into apparatuses 38, 40, 42, a portion of the fluid slurry could be injected directly into annular region 48 in a known manner such as through a crossover tool (not pictured) which allows the slurry to travel from the interior of workstring 30 to the exterior of workstring 30. Again, once this portion of the fluid slurry is in annular region 48, a portion the gravel in the fluid slurry is deposited in annular region 48. Some of the liquid carrier may enter formation 14 through perforation 48 while the remainder of the fluid carrier along with some of the gravel enters certain sections of apparatuses 38, 40, 42 filling those sections with gravel. The sand control screen (not pictured) within apparatuses 38, 40, 42 disallows further migration of the gravel but allows the liquid carrier to travel therethrough into workstring 30 and up to the surface. If the fluid slurry is partially injected directly into annular region 48 and a sand bridge forms, the portion of the fluid slurry that is injected into apparatuses 38, 40, 42 will bypass this sand bridge such that a complete pack can nonetheless be achieved. The portion of the fluid slurry entering apparatuses 38, 40, 42 may enter apparatuses 38, 40, 42 directly from workstring 30 or may enter apparatuses 38, 40, 42 from annular region 48 via one or more inlets on the exterior of one or more of the apparatuses 38, 40, 42. These inlets may include pressure actuated devices, such as valves, rupture disks and the like disposed therein to regulate the flow of the fluid slurry therethrough.

Even though FIG. 1 depicts a vertical well, it should be noted by one skilled in the art that the apparatus for gravel packing an interval of a wellbore of the present invention is equally well-suited for use in deviated wells, inclined wells or horizontal wells. Also, even though FIG. 1 depicts an offshore operation, it should be noted by one skilled in the art that the apparatus for gravel packing an interval of a wellbore of the present invention is equally well-suited for use in onshore operations.

Figure 2:
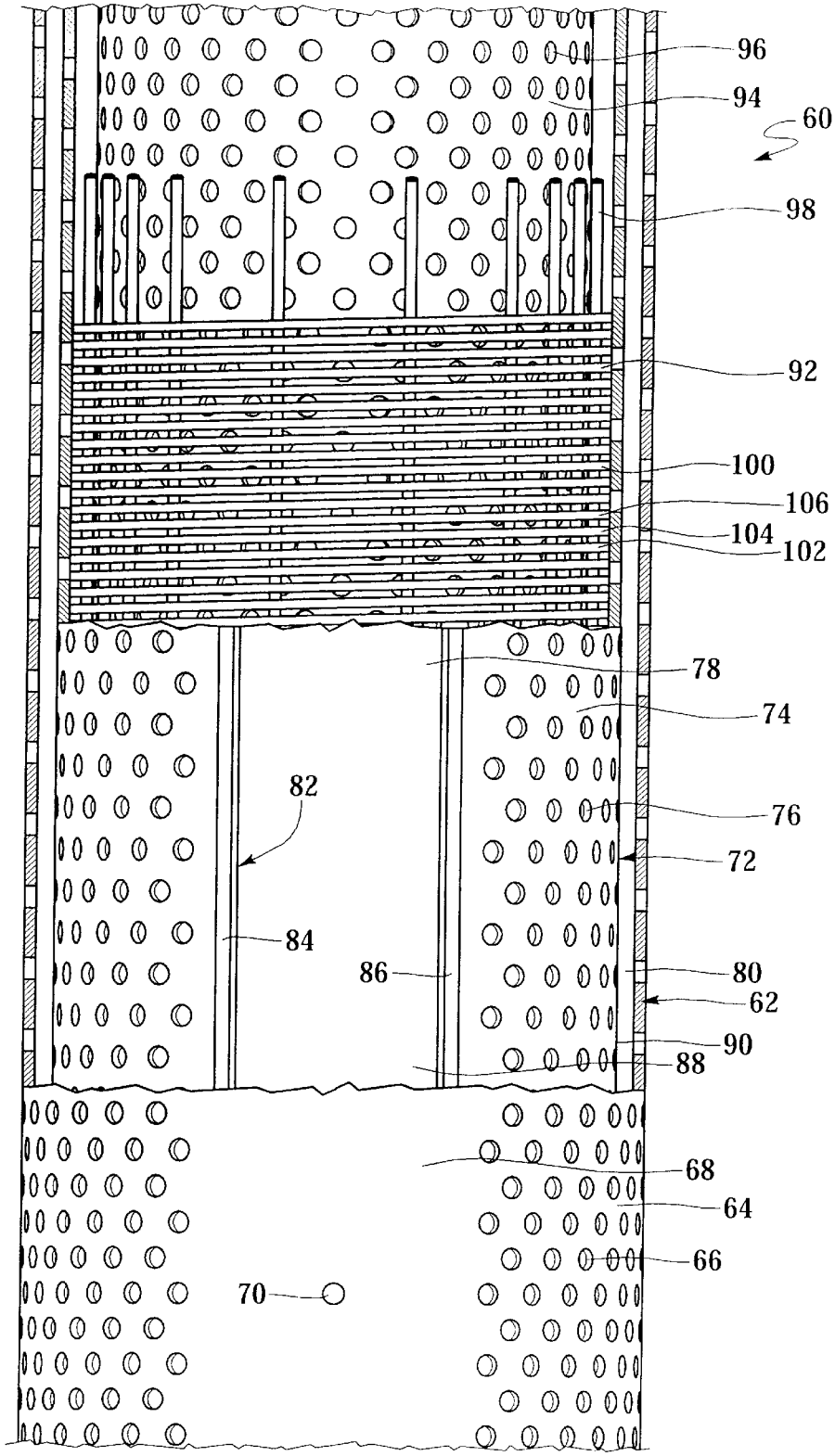
FIG. 2 is partial cut away view of an apparatus for gravel packing an interval of a wellbore of the present invention in position around a sand control screen.

Referring now to FIG. 2, therein is depicted a partial cut away view of an apparatus for gravel packing an interval of a wellbore of the present invention that is generally designated 60. Apparatus 60 has an outer tubular 62. A portion of the side wall of outer tubular 62 is an axially extending production section 64 that includes a plurality of openings 66. Another portion of the side wall of outer tubular 62 is an axially extending nonproduction section 68 that includes one or more outlets 70. For reasons that will become apparent to those skilled in the art, the density of opening 66 within production section 64 of outer tubular 62 is much greater than the density of outlets 70 in nonproduction section 68 of outer tubular 62. Also, it should be noted by those skilled in the art that even though FIG. 2 has depicted openings 66 and outlet 70 as being circular, other shaped openings may alternatively be used without departing form the principles of the present invention. Likewise, even though FIG. 2 has depicted openings 66 as being the same size as outlet 70, openings 66 could alternatively be larger or smaller than outlet 70 without departing from the principles of the present invention. In addition, the exact number, size and shape of openings 66 are not critical to the present invention, so long as sufficient area is provided for fluid production therethrough and the integrity of outer tubular 62 is maintained.

Disposed within outer tubular 62 is an inner tubular 72. A portion of the side wall of inner tubular 72 is an axially extending production section 74 that is substantially circumferentially aligned with production section 64 of outer tubular 62. Production section 74 of inner tubular 72 has a plurality of opening 76 therethrough. Again, the exact number, size and shape of openings 76 are not critical to the present invention, so long as sufficient area is provided for fluid production and the integrity of inner tubular 74 is maintained. Another portion of the side wall of inner tubular 72 is an axially extending nonproduction section 78 that is substantially circumferentially aligned with nonproduction section 68 of outer tubular 62. Nonproduction section 78 of inner tubular 72 has no openings therethrough.

Disposed within an annulus 80 between outer tubular 62 and inner tubular 72 is an isolation member 82. As further explained below, isolation member 82 includes a pair of substantially parallel, circumferentially spaced apart, axially extending members 84, 86 that radially extend between outer tubular 62 and inner tubular 72. In fact, members 84, 86 provide circumferential fluid isolation between production section 64 and nonproduction section 68 of outer tubular 62. In addition, members 84, 86 provide circumferential fluid isolation between production section 74 and nonproduction section 78 of inner tubular 72. As such, members 84, 86 define the circumferential boundary between a slurry passageway 88, having radial boundaries defined by nonproduction section 68 of outer tubular 62 and nonproduction section 78 of inner tubular 72, and a production pathway 90, having radial boundaries defined by production section 64 of outer tubular 62 and production section 74 of inner tubular 72.

Disposed within inner tubular 72 is a sand control screen 92. Sand control screen 92 includes a base pipe 94 that has a plurality of openings 96 which allow the flow of production fluids into the production tubing. The exact number, size and shape of openings 96 are not critical to the present invention, so long as sufficient area is provided for fluid production and the integrity of base pipe 94 is maintained.

Spaced around base pipe 94 is a plurality of ribs 98. Ribs 98 are generally symmetrically distributed about the axis of base pipe 94. Ribs 98 are depicted as having a cylindrical cross section, however, it should be understood by one skilled in the art that ribs 98 may alternatively have a rectangular or triangular cross section or other suitable geometry. Additionally, it should be understood by one skilled in the art that the exact number of ribs 98 will be dependent upon the diameter of base pipe 94 as well as other design characteristics that are well known in the art.

Wrapped around ribs 98 is a screen wire 100. Screen wire 100 forms a plurality of turns, such as turn 102, turn 104 and turn 106. Between each of the turns is a gap through which formation fluids flow. The number of turns and the gap between the turns are determined based upon the characteristics of the formation from which fluid is being produced and the size of the gravel to be used during the gravel packing operation. Together, ribs 98 and screen wire 100 may form a sand control screen jacket which is attached to base pipe 94 by welding or other suitable technique. It should be understood by those skilled in the art that while ribs 98 and the sand control screen jacket are depicted in FIG. 2, a wire mesh may alternatively be used in place of either or both to form the barrier to sand production or screen wire 100 may be wrapped directly around base pipe 94.

Figure 3:
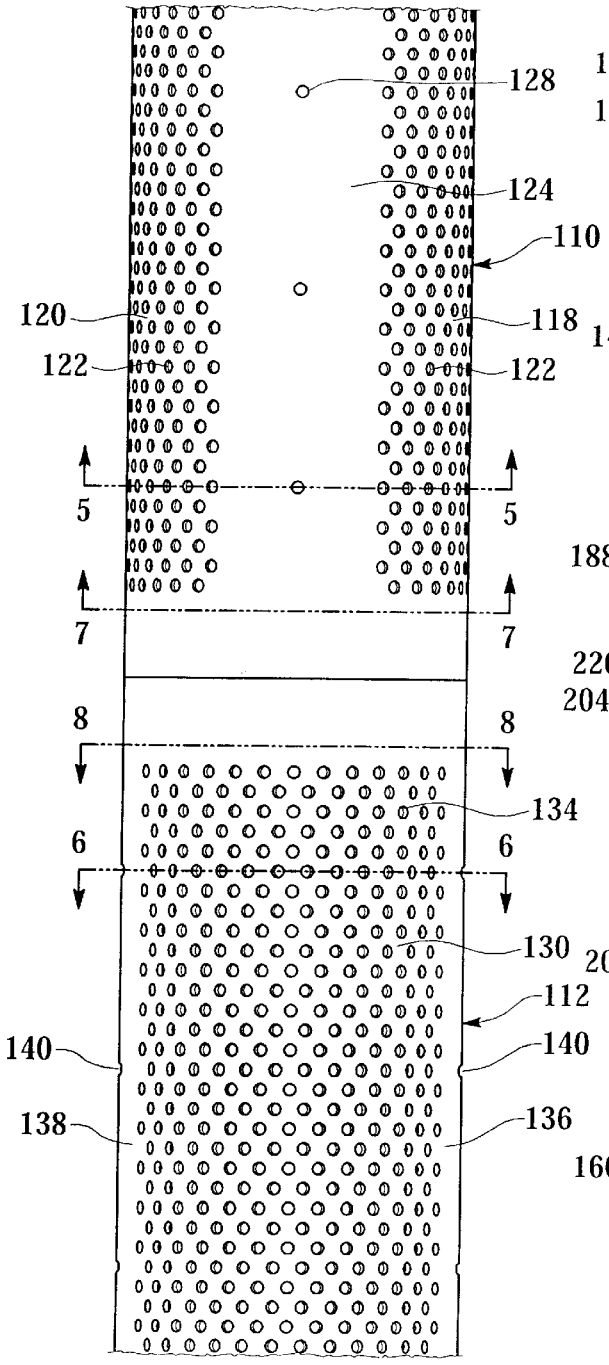
FIG. 3 is a side view of portions of-two sections of an apparatus for gravel packing an interval of a wellbore of the present invention that are coupled together.
Figure 4:
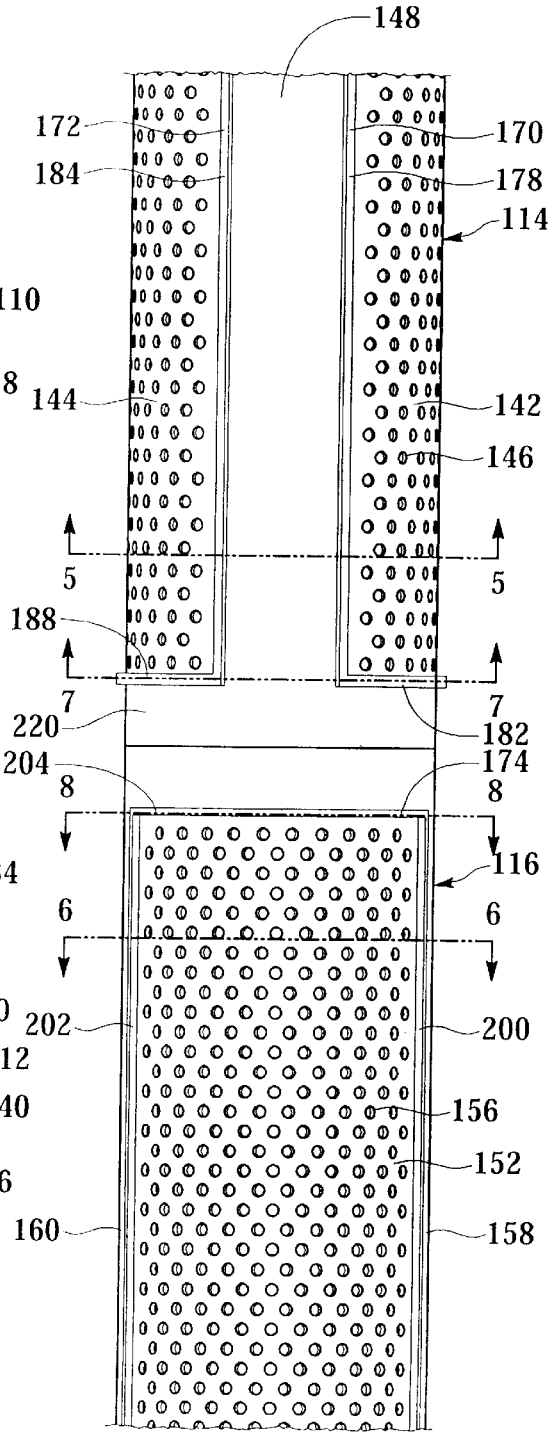
FIG. 4 is a side view of portions of two inner tubulars of an apparatus for gravel packing an interval of a wellbore of the present invention that are coupled together.

Referring now to FIGS. 3 and 4, therein is depicted portions of two sections of outer tubulars designated 110 and 112 and corresponding portions of two sections of inner tubulars designated 114 and 116, respectively. Outer tubular 110 has two axially extending production sections 118, 120 each including a plurality of openings 122. Outer tubular 110 also has two axially extending nonproduction sections 124, 126, only one of which is visible in FIG. 3. Each nonproduction section 124, 126 includes several outlets 128. Likewise, outer tubular 112 has two axially extending production sections 130, 132, only one of which is visible in FIG. 3. Each production section 130, 132 includes a plurality of openings 134. Outer tubular 112 also has two axially extending nonproduction sections 136, 138, each of which includes several outlets 140. As should become apparent to those skilled in the art, even though FIG. 3 depicts outer tubular 110 and outer tubular 112 at a ninety-degree circumferential phase shift relative to one another, any degree of circumferential phase shift is acceptable using the present invention as the relative circumferential positions of adjoining sections of the apparatuses for gravel packing an interval of a wellbore of the present invention does not affect the operation of the present invention. As such, the mating of adjoining sections of the apparatuses for gravel packing an interval of a wellbore of the present invention is substantially similar to mating typical joints of pipe to form a pipe string requiring no special coupling tools or techniques.

Inner tubular 114 has two axially extending production sections 142, 144 each including a plurality of openings 146. Inner tubular 114 also has two axially extending nonproduction sections 148, 150, only one of which is visible in FIG. 4. There are no openings in nonproduction sections 148, 150. Likewise, inner tubular 116 has two axially extending production sections 152, 154, only one of which is visible in FIG. 4. Each production section 152, 154 includes a plurality of openings 156. Inner tubular 116 also has two axially extending nonproduction sections 158, 160, neither of which include any openings.

Figure 5:
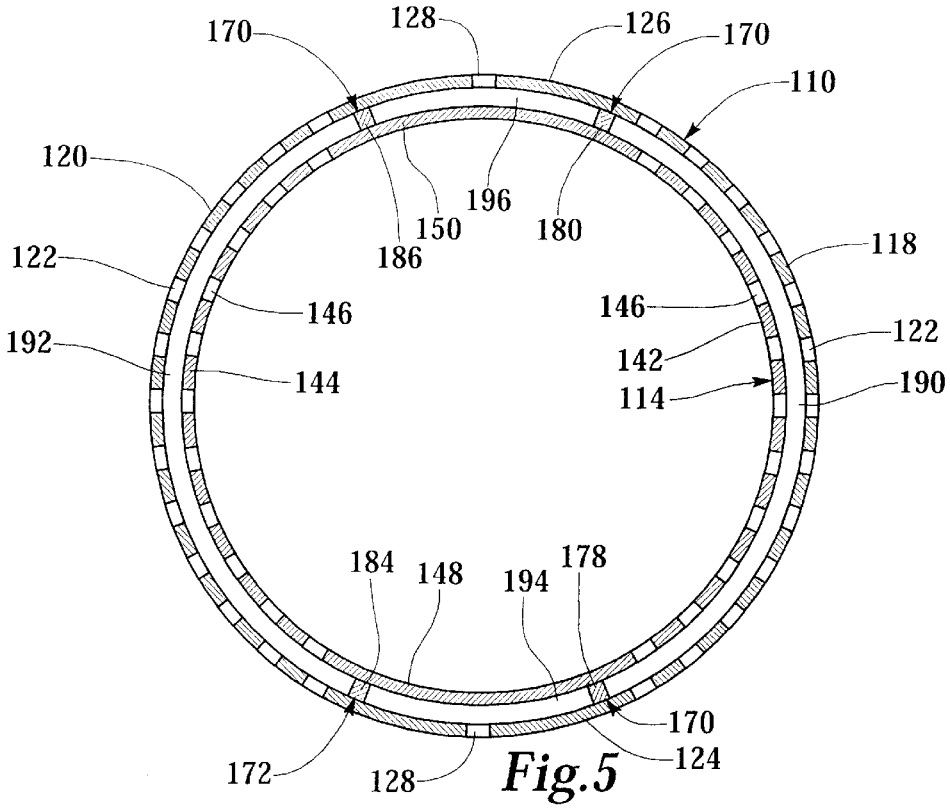
FIG. 5 is a cross sectional view of an apparatus for gravel packing an interval of a wellbore of the present invention taken along line 5—5 of FIGS. 3 and 4.
Figure 6:
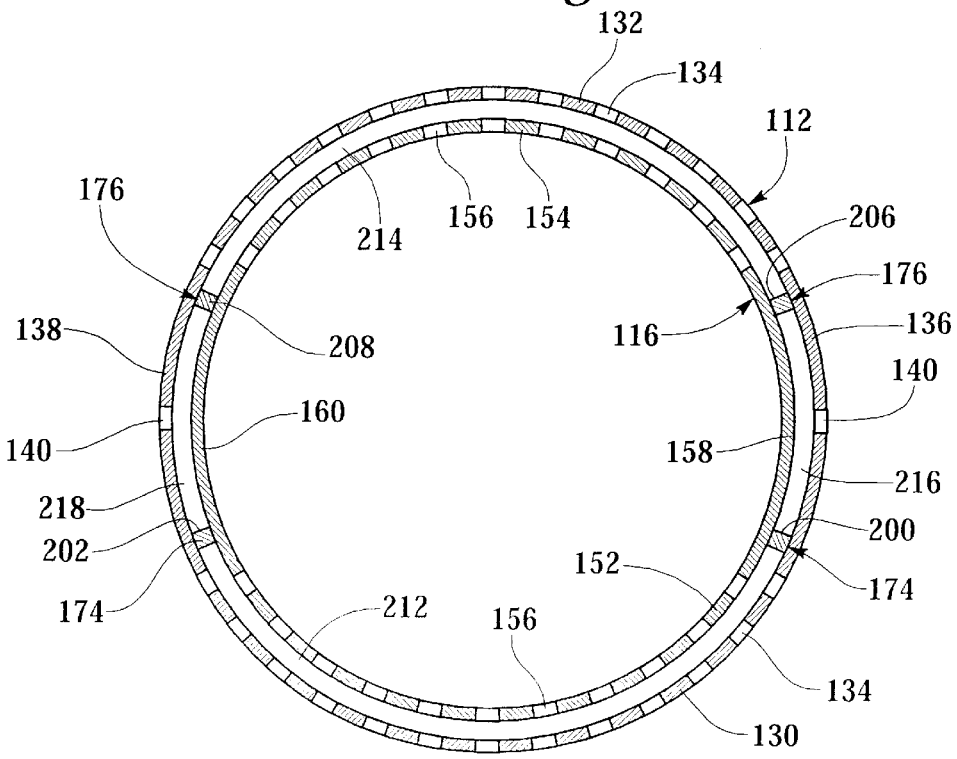
FIG. 6 is a cross sectional view of an apparatus for gravel packing an interval of a wellbore of the present invention taken along line 6—6 of FIGS. 3 and 4.

In the illustrated embodiment, inner tubulars 114, 116 would be positioned within outer tubulars 110, 112 such that production sections 118, 120 of outer tubular 110 are circumferentially aligned with production sections 142, 144 of inner tubular 114, as best seen in FIG. 5; such that nonproduction sections 124, 126 of outer tubular 110 are circumferentially aligned with nonproduction sections 148, 150 of inner tubular 114, also as best seen in FIG. 5; such that production sections 130, 132 of outer tubular 112 are circumferentially aligned with production sections 152, 154 of inner tubular 116, as best seen in FIG. 6; and such that nonproduction sections 136, 138 of outer tubular 112 are circumferentially aligned with nonproduction sections 158, 160 of inner tubular 116, also as best seen in FIG. 6.

Figure 7:
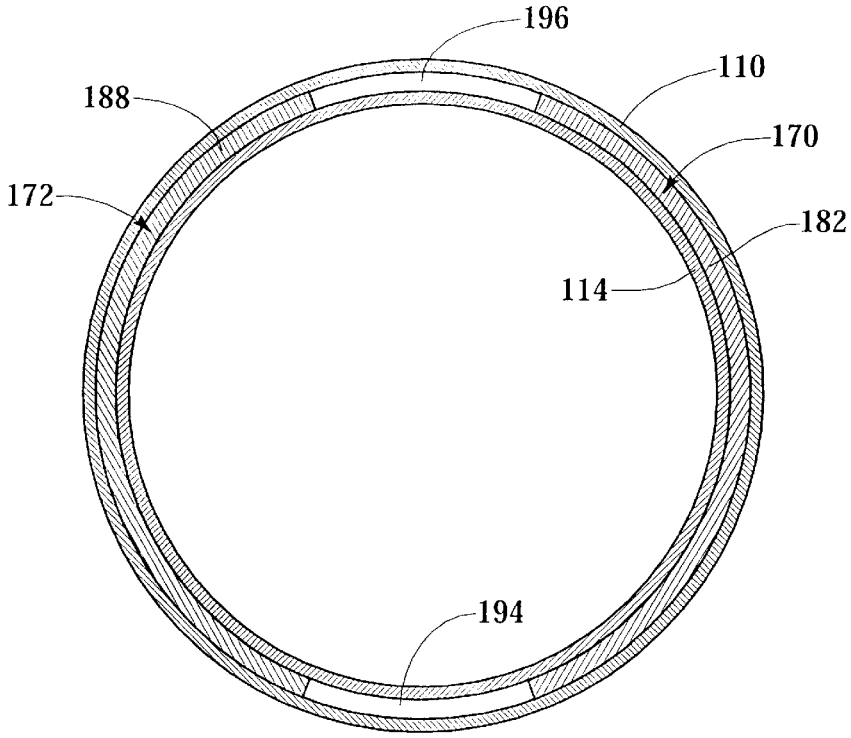
FIG. 7 is a cross sectional view of an apparatus for gravel packing an interval of a wellbore of the present invention taken along line 7—7 of FIGS. 3 and 4.

Referring again to FIG. 4, inner tubular 114 has a pair of isolation members 170, 172 attached thereto and inner tubular 116 has a pair of isolation members 174, 176 attached thereto, only one of which is visible in FIG. 4. Isolation member 170 has a pair of circumferentially spaced apart substantially axial members 178, 180, as best seen in FIG. 5 and a pair of axially spaced apart substantially circumferential members, only member 182 being shown in FIGS. 4 and 7. Isolation member 172 has a pair of circumferentially spaced apart substantially axial members 184, 166, as best seen in FIG. 5 and a pair of axially spaced apart substantially circumferential members, only member 188 being shown in FIGS. 4 and 7. Together, members 170, 172 define the circumferential boundaries of production pathways 190, 192 and slurry passageways 194, 196 between outer tubular 110 and inner tubular 114. Also, members 170, 172 provide fluid isolation between production pathways 190, 192 and slurry passageways 194, 196. Further, members 170 and 172 provide complete fluid isolation for production pathways 190, 192.

Figure 8:
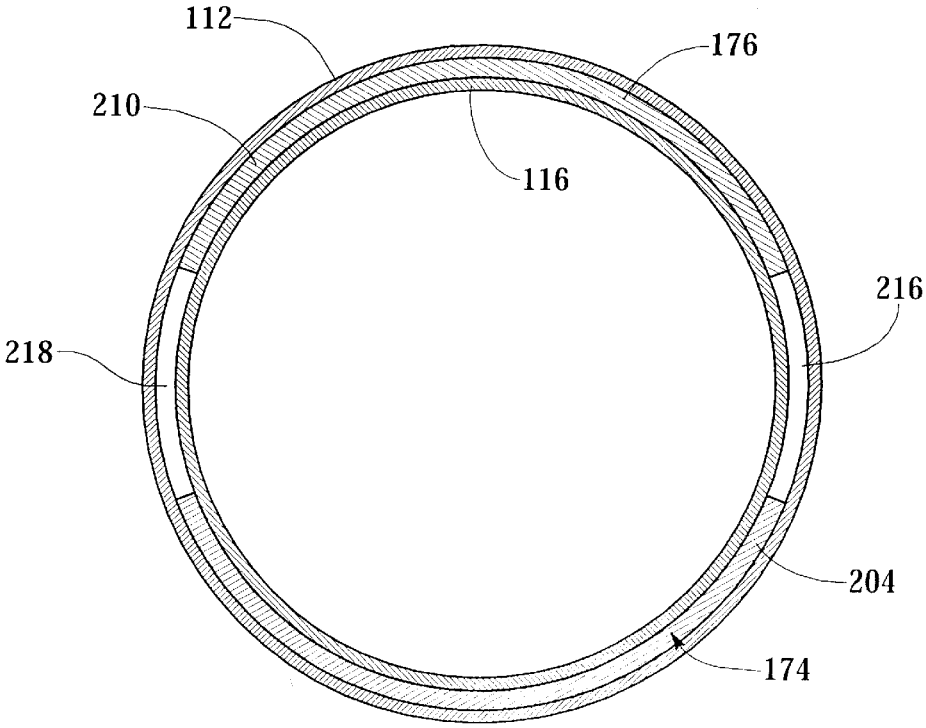
FIG. 8 is a cross sectional view of an apparatus for gravel packing an interval of a wellbore of the present invention taken along line 8—8 of FIGS. 3 and 4.

Isolation member 174 has a pair of circumferentially spaced apart substantially axial members 200, 202, as best seen in FIG. 6 and a pair of axially spaced apart substantially circumferential members, only member 204 being shown in FIGS. 4 and 8. Isolation member 176 has a pair of circumferentially spaced apart substantially axial members 206, 208, as best seen in FIG. 6 and a pair of axially spaced apart substantially circumferential members, only member 210 being shown in FIG. 8. Together, members 174, 176 define the circumferential boundaries of production pathways 212, 214 and slurry passageways 216, 218 between outer tubular 112 and inner tubular 116. Also, members 174, 176 provide fluid isolation between production pathways 212, 214 and slurry passageways 216, 218. Further, members 174, 176 provide complete fluid isolation for production pathways 216, 218. Importantly, however, slurry passageways 194, 196 and slurry passageways 212, 214 are all in fluid communication with one another such that a fluid slurry may travel in and between these passageways from one section of the apparatuses for gravel packing an interval of a wellbore of the present invention to the next. Specifically, as best seen in FIGS. 3, 4, 7 and 8 collectively, an annular region 220 exists between outer tubulars 110, 112 and inner tubulars 114, 116 that allows the fluid slurry to travel downwardly from slurry passageways 194, 196 through annular regions 220 into slurry passageways 216, 218. As such, regardless of the circumferential orientation of inner tubular 114 relative to inner tubular 116, the fluid slurry will travel down through each section of the apparatuses for gravel packing an interval of a wellbore of the present invention.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction-being toward the bottom of the corresponding figure. It should be noted, however, that the apparatus for gravel packing an interval of a wellbore is not limited to such orientation as it is equally-well suited for use in inclined and horizontal orientations.

Figure 9:
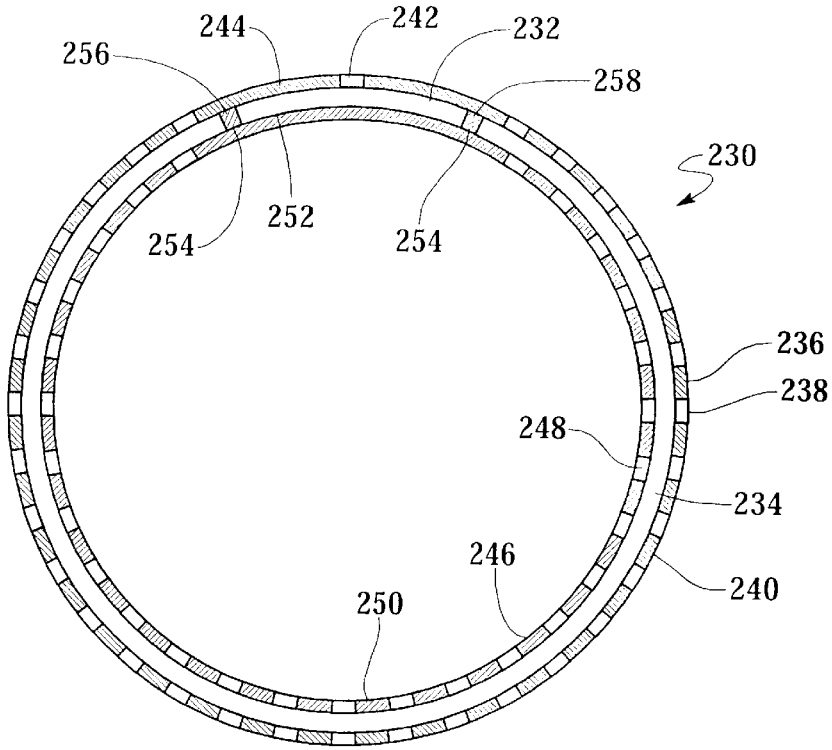
FIG. 9 is a cross sectional view of an alternate embodiment of an apparatus for gravel packing an interval of a wellbore of the present invention depicting one slurry passageway and one production pathway.
Figure 10:
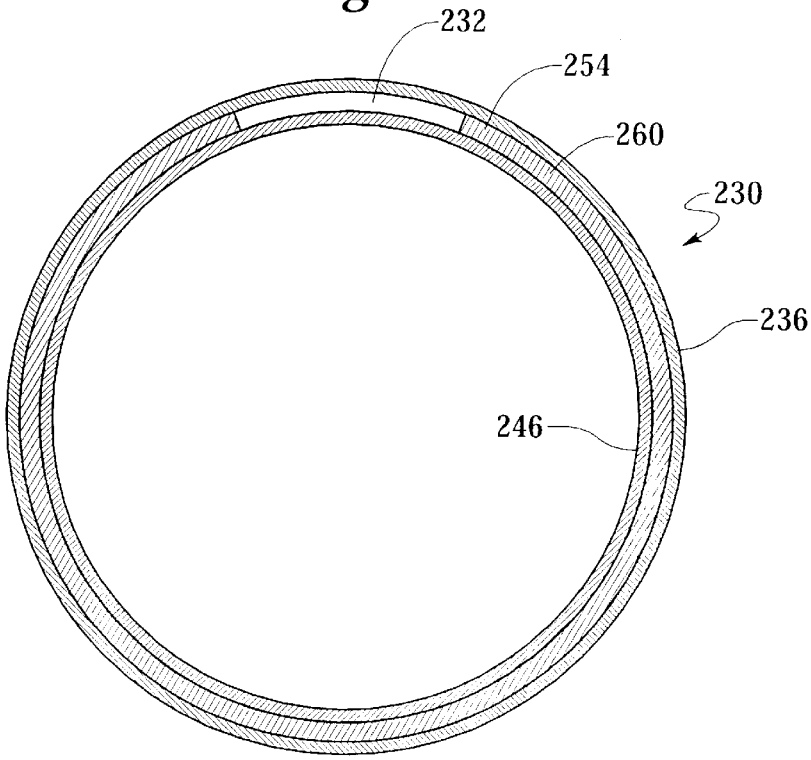
FIG. 10 is a cross sectional view of an alternate embodiment of an apparatus for gravel packing an interval of a wellbore of the present invention depicting one slurry passageway and a circumferential section of an isolation member.

Referring now to FIGS. 9 and 10, therein is depicted cross sectional views of an alternate embodiment of an apparatus for gravel packing an interval of a wellbore that is generally designated 230. Apparatus 230 is similar to that shown in FIGS. 5 and 7 except apparatus 230 has a single slurry passageway 232 and a single production pathway 234. Specifically, apparatus 230 has an outer tubular 236 including a plurality of openings 238 in its production section 240 and an outlet 242 in its nonproduction section 244. Apparatus 230 also has an inner tubular 246 including a plurality of openings 248 in its production section 250 and no openings in its nonproduction section 252. An isolation member 254 is disposed between outer tubular 236 and inner tubular 246. Isolation member 254 has a pair of circumferentially spaced apart substantially axial members 256, 258 and a pair of axially spaced apart substantially circumferential members, only member 260 being shown in FIG. 10. Isolation member 254 defines the circumferential boundaries of production pathway 234 and slurry passageway 232 between outer tubular 236 and inner tubular 246. Also, isolation member 254 provides fluid isolation between production pathway 234 and slurry passageway 232 and complete fluid isolation for production pathway 234.

Figure 11:
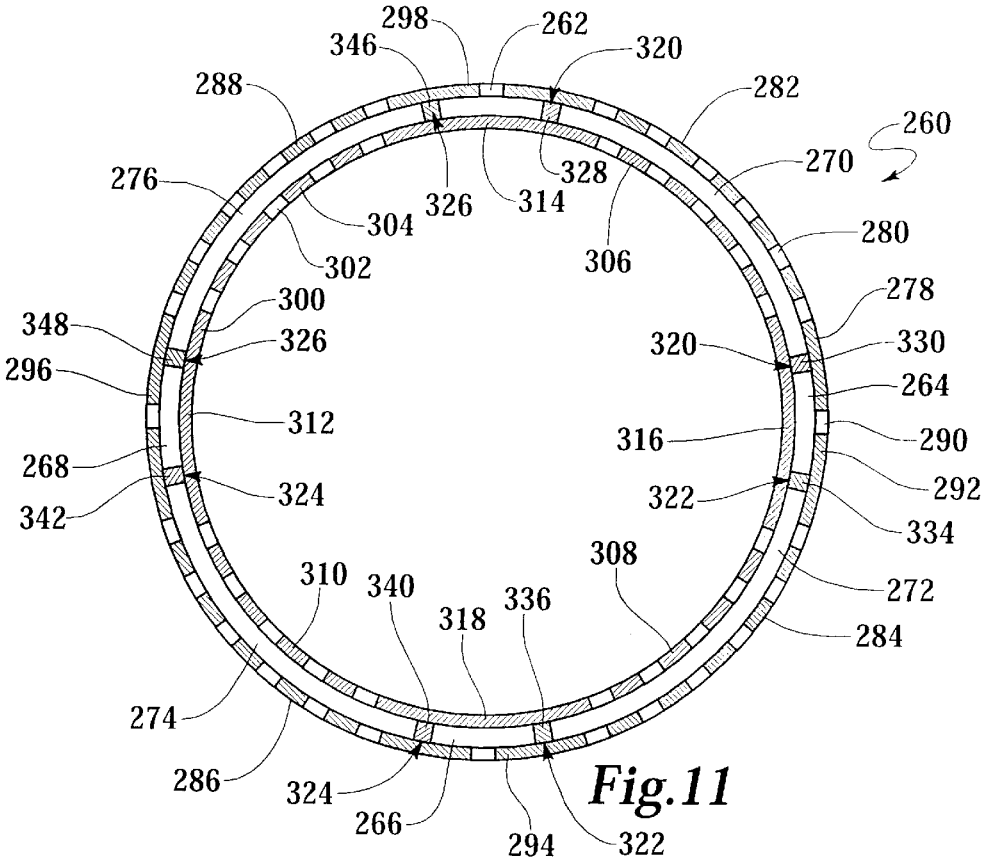
FIG. 11 is a cross sectional view of an alternate embodiment of an apparatus for gravel packing an interval of a wellbore of the present invention depicting four slurry passageways and four production pathways.
Figure 12:
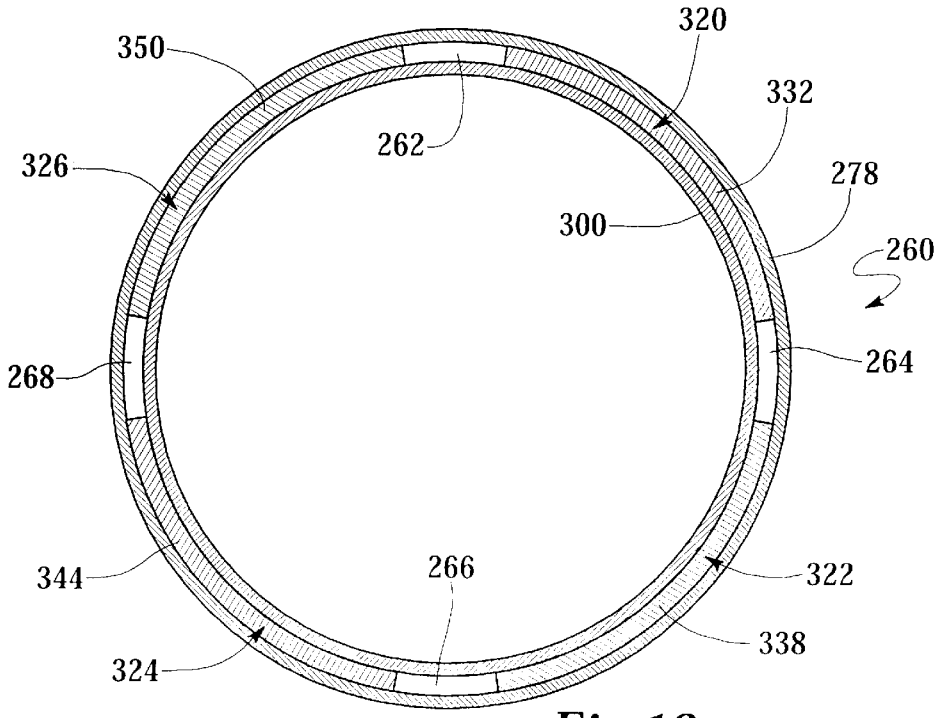
FIG. 12 is a cross sectional view of an alternate embodiment of an apparatus for gravel packing an interval of a wellbore of the present invention depicting four slurry passageways and a circumferential section of four isolation members.

Referring now to FIGS. 11 and 12, therein is depicted cross sectional views of another embodiment of an apparatus for gravel packing an interval of a wellbore that is generally designated 260. Apparatus 260 is similar to that shown in FIGS. 5 and 7 except apparatus 260 has four slurry passageways 262, 264, 266, 268 and four production pathway 270, 272, 274, 276. Specifically, apparatus 260 has an outer tubular 278 including a plurality of openings 280 in its four production sections 282, 284, 286, 288 and outlets 290 in its nonproduction sections 292, 294, 296, 298. Apparatus 260 also has an inner tubular 300 including a plurality of openings 302 in its production sections 304, 306, 308, 310 and no openings in its nonproduction sections 312, 314, 316, 318. Four isolation members 320, 322, 324, 326 are disposed between outer tubular 278 and inner tubular 300.

Isolation member 320 has a pair of circumferentially spaced apart substantially axial members 328, 330 and a pair of axially spaced apart substantially circumferential members, only member 332 being shown in FIG. 12. Isolation member 322 has a pair of circumferentially spaced apart substantially axial members 334, 336 and a pair of axially spaced apart substantially circumferential members, only member 338 being shown in FIG. 12. Isolation member 324 has a pair of circumferentially spaced apart substantially axial members 340, 342 and a pair of axially spaced apart substantially circumferential members, only member 344 being shown in FIG. 12. Isolation member 326 has a pair of circumferentially spaced apart substantially axial members 346, 348 and a pair of axially spaced apart substantially circumferential members, only member 350 being shown in FIG. 12. Isolation members 320, 322, 324, 326 define the circumferential boundaries of production pathways 270, 272, 274, 276 and slurry passageways 262, 264, 266, 268 between outer tubular 278 and inner tubular 300. Also, isolation members 320, 322, 324, 326 provides fluid isolation between production pathways 270, 272, 274, 276 and slurry passageways 262, 264, 266, 268 and complete fluid isolation for each of the production pathways 270, 272, 274 276.

As should be apparent from FIGS. 3–12, the apparatus for gravel packing an interval of a wellbore of the present invention may have a variety of configurations including configuration having one, two and four slurry passageways. Other configuration having other numbers of slurry passageways are also possible and are considered within the scope of the present invention.

In addition, it should be understood by those skilled in the art that use of various configurations of the apparatus for gravel packing an interval of a wellbore of the present invention in the same interval is likely and may be preferred. Specifically, it may be desirable to have a volumetric capacity within the slurry passageways that is greater toward the top, in a vertical well, or heel, in an inclined or horizontal well, of a string of consecutive apparatuses of the present invention than toward the bottom or toe of the interval. This may be achieved by using apparatuses of the present invention having more slurry passageways near the top or heel of the interval and less slurry passageways near the bottom or toe of the interval. This may also be achieved by using apparatuses of the present invention having wider slurry passageways near the top or heel of the interval and narrower slurry passageways near the bottom or toe of the interval.

Also, while the illustrated embodiments have depicted the isolation members of the apparatus of the present invention as having a pair of circumferentially spaced apart substantially parallel axial members, it should be understood by those skilled in the art that other configurations of the isolation members are possible and are considered within the scope of the present invention. For example, the isolation members may have a pair of circumferentially spaced apart substantially axial members that are not parallel to one another wherein the substantially axial members are circumferentially closer together at one end of the inner tubular than at the other end. Likewise, the isolation member may have a pair of circumferentially spaced apart members that are not substantially axial members but instead extend across the length of the inner tubular in an inclined or helical configuration.

Figure 13:
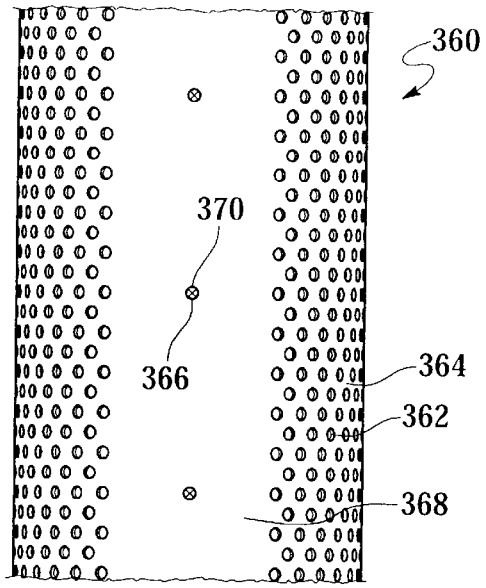
FIG. 13 is a side view of a portion of an outer tubular of an apparatus for gravel packing an interval of a wellbore of the present invention that has actuatable devices in the outlets of the slurry passageway.

Referring now to FIG. 13 therein is depicted a side view of a portion of an outer tubular of an apparatus for gravel packing an interval of a wellbore that is generally designated 360. Outer tubular 360 includes a plurality of openings 362 in its production section 364 and outlets 366 in its nonproduction section 368. Disposed within each outlet 368 is an actuatable device 370. Actuatable devices 370 are used to selectively allow and prevent the flow of the fluid slurry through a particular outlet 366 such that the gravel packing process may be precisely controlled. For example, actuatable devices 370 could be opened and closed in a particular sequence to further improve the gravel packing process, such as from top to bottom or bottom to top in a substantially vertical wellbore or from heel to toe or toe to heel in a substantially horizontal wellbore. In fact, actuatable devices 370 could be sequenced from heel to toe then from toe to heel in a substantially horizontal wellbore to even further enhance the gravel packing process. Actuatable devices 370 may be operated by a variety of known techniques including pressure actuation, electrical actuation, acoustic actuation or the like. Examples of suitable actuatable devices 370 include rupture disks, valves, such as one way valves and the like.

Figure 14A:
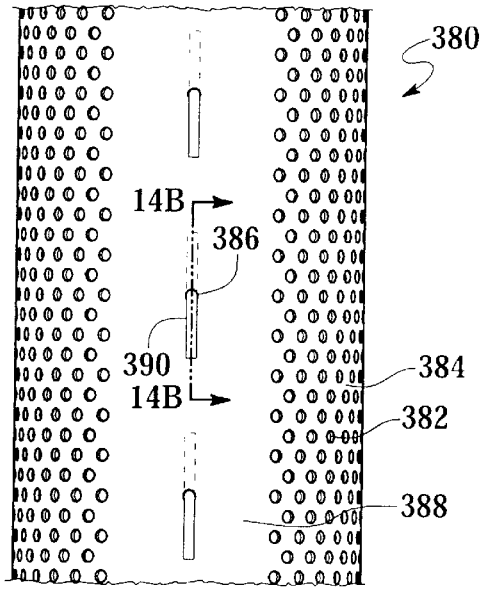
FIGS. 14A–14B are side and cross sectional views, respectively, of a portion of an outer tubular of an apparatus for gravel packing an interval of a wellbore of the present invention including exit tubes in the outlets of the slurry passageway.
Figure 14B:
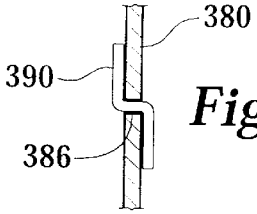

Referring now to FIGS. 14A and 14B therein are depicted a portion of an outer tubular of an apparatus for gravel packing an interval of a wellbore that is generally designated 380. Outer tubular 380 includes a plurality of openings 382 in its production section 384 and outlets 386 in its nonproduction section 388. Disposed within each outlet 386 is an exit tube 390. Exit tubes 390 are used to increase the pressure drop of the fluid slurry as the fluid slurry exits a slurry passageway which improves the gravel packing process. In the illustrated embodiment, a portion of each exit tube 390 is disposed within outer tubular 380 and another portion of each exit tube 390 is disposed exteriorly of outer tubular 380. It should be understood by those skilled in that art, however, the other configurations of exit tubes 390 are possible and are considered within the scope of the present invention.

Figure 15A:
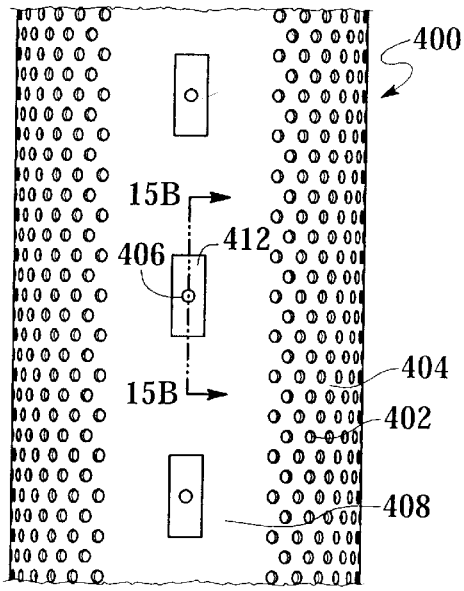
FIGS. 15A–15B are side and cross sectional views, respectively, of a portion of an outer tubular of an apparatus for gravel packing an interval of a wellbore of the present invention including insert members in the outlets of the slurry passageway.
Figure 15B:
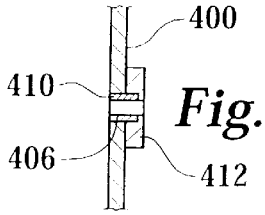

Referring now to FIGS. 15A and 15B therein are depicted a portion of an outer tubular of an apparatus for gravel packing an interval of a wellbore that is generally designated 400. Outer tubular 400 includes a plurality of openings 402 in its production section 404 and outlets 406 in its nonproduction section 408. Partially disposed within each outlet 406 is an insert member 410 which is also partially disposed in a plate member 412. Insert members 410 are used to prevent the erosion of outlets 406 which may occur due to the pressure and velocity at which the fluid slurry travels therethrough. Insert members 410 may be made from any suitably nonerosive material such as tungsten carbide. Even though the illustrated embodiment depicts insert members 410 as having a circular cross section, it should be understood by those skilled in that art that insert members having alternate shaped cross sections, such as square or triangular, are also suitable.

Figure 16:
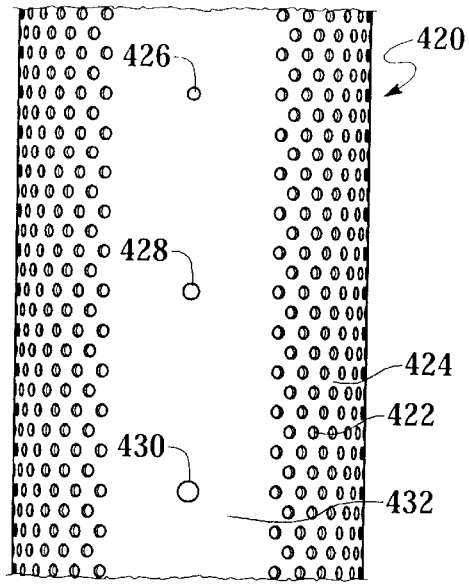
FIG. 16 is a side view of a portion of an outer tubular of an apparatus for gravel packing an interval of a wellbore of the present invention having outlets of different sizes.

Referring now to FIG. 16 therein is depicted a portion of an outer tubular of an apparatus for gravel packing an interval of a wellbore that is generally designated 420. Outer tubular 420 includes a plurality of openings 422 in its production section 424 and outlets 426, 428, 430 in its nonproduction section 432. As illustrated, outlet 426 is smaller than outlet 428. In addition, outlet 426 and outlet 428 are smaller than outlet 430. Having various sized outlets along the length of one or more sections of an apparatus for gravel packing an interval of a wellbore of the present invention can improve the gravel packing process due to the expected pressure drop in the fluid slurry as the fluid slurry travels down through the various slurry passageways of the various sections.

Figure 17:
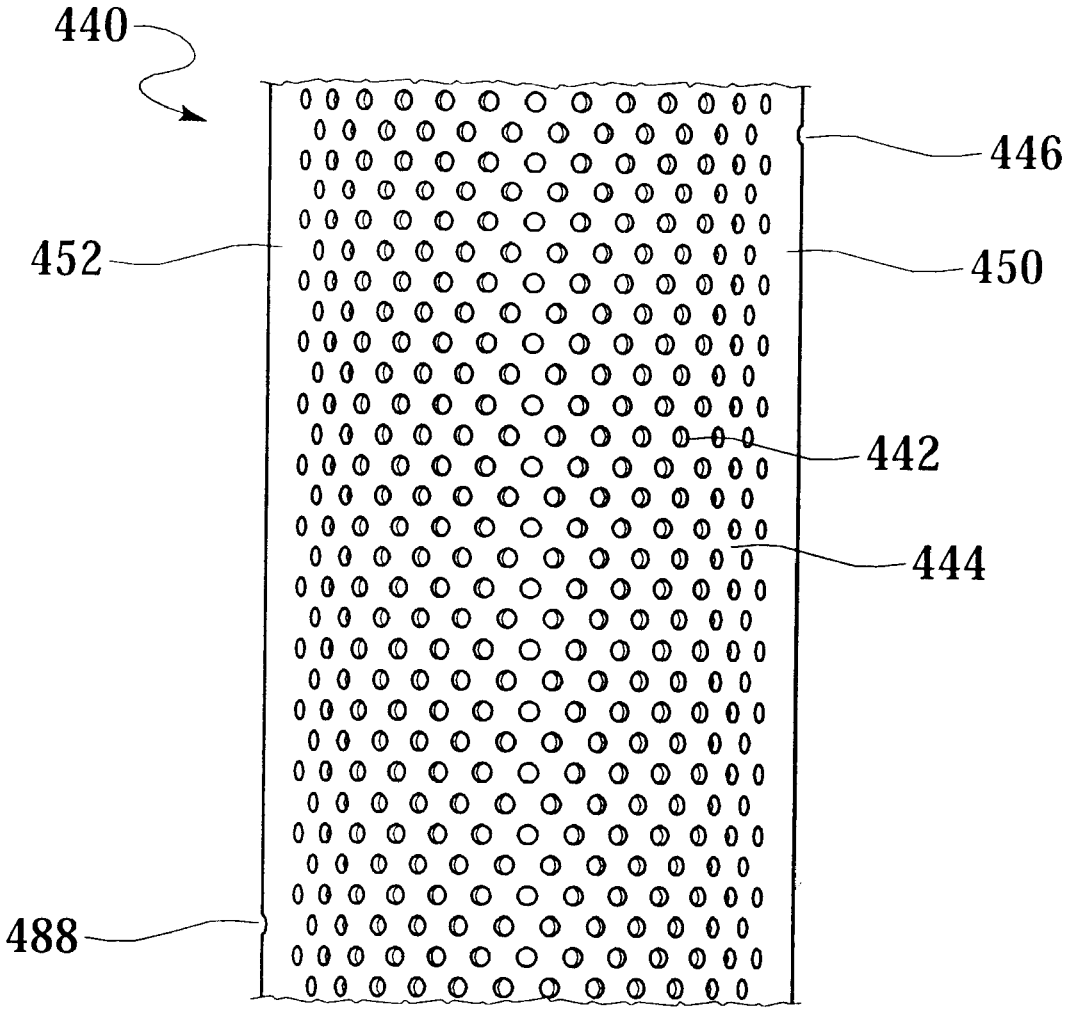
FIG. 17 is a side view of a portion of an outer tubular of an apparatus for gravel packing an interval of a wellbore of the present invention that has outlets at different axial positions along the outer tubular for different slurry passageways.

Referring now to FIG. 17 therein is depicted a portion of an outer tubular of an apparatus for gravel packing an interval of a wellbore that is generally designated 440. Outer tubular 440 includes a plurality of openings 442 in the illustrated production section 444 and a pair of outlets 446, 448 in the oppositely positioned nonproduction sections 450, 452. As illustrated, outlet 446 is at a different axial position along outer tubular 440 than outlet 448. Having the position of outlets 446, 448 at different axial locations along the length outer tubular 440 can improve the gravel packing process by injecting the fluid slurry in different direction at different axial position.

In operation, the apparatus for gravel packing an interval of a wellbore of the present invention is used to distribute the fluid slurry to various locations within the interval to be gravel packed by injecting the fluid slurry into the slurry passageways of one or more sections of the apparatuses. A portion of the fluid slurry exits through the various outlets along the slurry passageway and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlet. This process progresses along the entire length of the apparatus such that the annular area becomes completely packed with the gravel. In addition, a portion of the fluid slurry enters the opening in the production sections of the outer tubular which provides for the deposit of a portion of the gravel from the fluid slurry in each production pathway of the various sections of the apparatus. Again, this process progresses along the entire length of the apparatus such that each production pathway becomes completely packed with the gravel. Once both the annulus and the production pathways are completely packed with gravel, the gravel pack operation may cease.

In some embodiments of the present invention, the fluid slurry may not only be injected into the slurry passageways, but also injected directly into the annulus to increase the speed at which an interval of the wellbore may be gravel packed. In either embodiment, once the gravel pack is finish and the well is brought on line, formation fluids that are produced into the gravel packed interval must travel through the gravel pack in the annulus, then enter the production pathways through the openings in the outer tubular where the formation fluids pass through the gravel pack in the production pathway prior to exiting the production pathway through the openings in the inner tubular. Notably, the formation fluids are prevented from traveling radially through the slurry passageway as there are no openings in the nonproduction sections of the inner tubular. As such, the apparatus for gravel packing an interval of a wellbore of the present invention allows for a complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing an interval of a wellbore, the apparatus comprising:

an outer tubular having an axially extending production section with a plurality of openings and an axially extending nonproduction section with an outlet;

an inner tubular disposed within the outer tubular forming an annulus therebetween, the inner tubular having an axially extending production section that is substantially circumferentially aligned with the production section of the outer tubular and an axially extending nonproduction section that is substantially circumferentially aligned with the nonproduction section of the outer tubular, the production section of the inner tubular having plurality of openings, the nonproduction section of the inner tubular having no openings; and an isolation member disposed within the annulus forming a production pathway between the production sections of the outer and inner tubulars and a slurry passageway between the nonproductions sections of the outer and inner tubulars, the isolation member preventing fluid communication between the production pathway and the slurry passageway, such that when a fluid slurry containing gravel is injected through the slurry passageway, the fluid slurry exits the slurry passageway through the outlet leaving a first portion of the gravel in an annulus between the outer tubular and the wellbore then enters the plurality of opening in the outer tubular leaving a second portion of the gravel in the production pathway.

2. The apparatus as recited in claim 1 further comprising an actuatable device disposed within the outlet to selectively allow and prevent fluid flow therethrough.

3. The apparatus as recited in claim 2 wherein the actuatable device is pressure actuated.

4. The apparatus as recited in claim 2 wherein the actuatable device is a valve.

5. The apparatus as recited in claim 2 wherein the actuatable device is a rupture disk.

6. The apparatus as recited in claim 1 further comprising an exit tube disposed within the outlet.

7. The apparatus as recited in claim 6 wherein at least a portion of the exit tube is disposed within the annulus.

8. The apparatus as recited in claim 6 wherein at least a portion of the exit tube is disposed exteriorly of the outer tubular.

9. The apparatus as recited in claim 1 further comprising an insert member disposed at least partially within the outlet, the insert member comprising an erosion-resistant material.

10. The apparatus as recited in claim 1 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars that define the production pathway and the slurry passageway and prevent fluid communication therebetween.

11. The apparatus as recited in claim 1 further comprising a sand control screen disposed within the inner tubular.

12. The apparatus as recited in claim 1 wherein the outlet further comprises two outlets.

13. The apparatus as recited in claim 12 wherein the two outlets further comprise an outlet of a first size and an outlet of a second size.

14. The apparatus as recited in claim 1 wherein the axially extending production section in the outer tubular further comprises two axially extending production sections, wherein the axially extending nonproduction section in the outer tubular further comprises two, axially extending nonproduction sections, wherein the axially extending production section in the inner tubular further comprises two axially extending production sections, wherein the axially extending nonproduction section in the inner tubular further comprises two axially extending nonproduction sections, wherein the production pathway formed by the isolation member further comprises two production pathways and wherein the slurry passageway formed by the isolation member further comprises two slurry passageways.

15. The apparatus as recited in claim 14 wherein the outlets of the two nonproduction sections of the outer tubular are at different axial positions along the outer tubular.

16. The apparatus as recited in claim 1 wherein the axially extending production section in the outer tubular further comprises four axially extending production sections, wherein the axially extending nonproduction section in the outer tubular further comprises four axially extending nonproduction sections, wherein the axially extending production section in the inner tubular further comprises four axially extending production sections, wherein the axially extending nonproduction section in the inner tubular further comprises four axially extending nonproduction sections, wherein the production pathway formed by the isolation member further comprises four production pathways and wherein the slurry passageway formed by the isolation member further comprises four slurry passageways.

17. The apparatus as recited in claim 16 wherein the outlets of the four nonproduction sections of the outer tubular are at different axial positions along the outer tubular.

18. An apparatus for gravel packing an interval of a wellbore, the apparatus comprising:

an outer tubular forming a first annulus with the wellbore; and an inner tubular disposed within the outer tubular forming a second annulus therebetween, the second annulus including an axially extending slurry passageway and an axially extending production pathway, a portion of the outer tubular adjacent the slurry passageway having an outlet, a portion of both the outer and inner tubulars adjacent the production pathway having a plurality of openings, the slurry passageway being in fluid isolation from the production pathway such that when a fluid slurry containing gravel is injected through the slurry passageway, the fluid slurry exits the slurry passageway through the outlet leaving a first portion of the gravel in the first annulus then enters the openings in the outer tubular leaving a second portion of the gravel in the production pathway and such that when formation fluids are produced, the formation fluids enter the production pathway through the openings in the outer tubular and exit the production pathway through the openings in the inner tubular passing through the first portion of the gravel in the first annulus and the second portion of the gravel in the production pathway.

19. The apparatus as recited in claim 18 further comprising an actuatable device disposed within the outlet to selectively allow and prevent the flow of the fluid slurry therethrough.

20. The apparatus as recited in claim 19 wherein the actuatable device is pressure actuated.

21. The apparatus as recited in claim 19 wherein the actuatable device is a valve.

22. The apparatus as recited in claim 19 wherein the actuatable device is a rupture disk.

23. The apparatus as recited in claim 18 further comprising an exit tube disposed within the outlet to increase the pressure drop of the fluid slurry traveling therethrough.

24. The apparatus as recited in claim 23 wherein at least a portion of the exit tube is disposed within the first annulus.

25. The apparatus as recited in claim 23 wherein at least a portion of the exit tube is disposed within of the second annulus.

26. The apparatus as recited in claim 18 further comprising an insert member disposed at least partially within the outlet, the insert member comprising an erosion-resistant material.

27. The apparatus as recited in claim 18 further comprising an isolation member disposed within the second annulus defining the slurry passageway and the production pathway and preventing fluid communication therebetween.

28. The apparatus as recited in claim 27 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

29. The apparatus as recited in claim 18 further comprising a sand control screen disposed within the inner tubular.

30. The apparatus as recited in claim 18 further comprises a second outlet.

31. The apparatus as recited in claim 30 wherein the two outlets further comprise an outlet of a, first size and an outlet of a second size.

32. The apparatus as recited in claim 18 further comprising a second production pathway and a second slurry passageway.

33. The apparatus as recited in claim 32 wherein the outlets of the two slurry passageways are at different axial positions along the outer tubular.

34. The apparatus as recited in claim 18 further comprising second, third and fourth production pathways and second, third and fourth slurry passageways.

35. The apparatus as recited in claim 34 wherein the outlets of the four slurry passageways are at different axial positions along the outer tubular.

36. An apparatus for gravel packing an interval of a wellbore, the apparatus comprising first and second sections coupled together, each section comprising an outer tubular forming a first annulus with the wellbore and an inner tubular disposed within the outer tubular forming a second annulus therebetween, the second annulus including an axially extending slurry passageway and an axially extending production pathway, a portion of the outer tubular adjacent the slurry passageway having an outlet, a portion of both the outer and inner tubulars adjacent the production pathway having a plurality of openings, the slurry passageway being in fluid isolation from the production pathway, the slurry passageway of the first section being in fluid communication with the slurry passageway of the second section, the production pathway of the first section being in fluid isolation from the production pathway of the second section, such that when a fluid slurry containing gravel is injected through the slurry passageway, the fluid slurry exits the slurry passageway through the outlet leaving a first portion of the gravel in the first annulus then enters the openings in the outer tubular leaving a second portion of the gravel in the production pathway.

37. The apparatus as recited in claim 36 further comprising actuatable devices disposed within the outlets to selectively allow and prevent the flow of the fluid slurry therethrough.

38. The apparatus as recited in claim 36 further comprising exit tubes disposed within the outlets to increase the pressure drop of the fluid slurry traveling therethrough.

39. The apparatus as recited in claim 36 further comprising insert members disposed at least partially within the outlets, the insert members comprising an erosion-resistant material.

40. The apparatus as recited in claim 36 further comprising an isolation member disposed within the second annulus of each section, the isolation member defining the slurry passageway and the production pathway in each section and preventing fluid communication therebetween.

41. The apparatus as recited in claim 40 wherein each isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

42. The apparatus as recited in claim 36 further comprising a sand control screen disposed within the inner tubulars.

43. The apparatus as recited in claim 36 wherein the portion of the outer tubular adjacent the slurry passageway of each section has two outlets.

44. The apparatus as recited in claim 43 wherein the two outlets further comprise an outlet of a first size and an outlet of a second size.

45. The apparatus as recited in claim 36 wherein the second annulus of each section further comprises a second production pathway and a second slurry passageway.

46. The apparatus as recited in claim 45 wherein the outlets of the two slurry passageways of each section are at different axial positions along the outer tubular.

47. The apparatus as recited in claim 36 wherein the second annulus of each section further comprises second, third and fourth production pathways and second, third and fourth slurry passageways.

48. The apparatus as recited in claim 47 wherein the outlets of the four slurry passageways of each section are at different axial positions along the outer tubular.

49. A method for gravel packing an interval of a wellbore, the method comprising the steps of:

traversing a formation with the wellbore;

locating a sand control screen within the wellbore proximate the formation;

positioning a gravel packing apparatus around the sand control screen to form a first annulus between the gravel packing apparatus and the wellbore, the gravel packing apparatus comprising an outer tubular and an inner tubular disposed within the outer tubular forming a second annulus therebetween, the second annulus including an axially extending slurry passageway and an axially extending production pathway, the slurry passageway being in fluid isolation from the production pathway;

injecting a fluid slurry containing gravel through the slurry passageway such that the fluid slurry exits the slurry passageway through an outlet leaving a first portion of the gravel in the first annulus then enters openings in the outer tubular leaving a second portion of the gravel in the production pathway; and terminating the injecting.

50. The method as recited in claim 49 further comprising the step of actuating a device disposed within the outlet to selectively allow and prevent the flow of the fluid slurry therethrough.

51. The method as recited in claim 50 wherein the step of actuating a device further comprises actuating a pressure actuated device.

52. The method as recited in claim 50 wherein the step of actuating a device further comprises actuating a valve.

53. The method as recited in claim 50 wherein the step of actuating a device further comprises actuating a rupture disk.

54. The method as recited in claim 49 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through an exit tube disposed within the outlet to increase the pressure drop of the fluid slurry traveling therethrough.

55. The method as recited in claim 54 wherein at least a portion of the exit tube is disposed within the first annulus.

56. The method as recited in claim 54 wherein at least a portion of the exit tube is disposed within of the second annulus.

57. The method as recited in claim 49 further comprising the step of positioning an insert member at least partially in the outlet, the insert member comprising an erosion-resistant material.

58. The method as recited in claim 49 further comprising the step of disposing an isolation member within the second annulus to define the slurry passageway and the production pathway and to prevent fluid communication therebetween.

59. The method as recited in claim 58 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

60. The method as recited in claim 49 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through two outlets.

61. The method as recited in claim 60 further comprising the step of sizing one of the two outlets a first size and sizing the other of the two outlets a second size.

62. The method as recited in claim 49 wherein injecting a fluid slurry containing gravel through the slurry passageway further comprises injecting a fluid slurry containing gravel through first and second slurry passageways.

63. The method as recited in claim 62 wherein the step of injecting a fluid slurry containing gravel through the slurry passageway such that the fluid slurry exits the slurry passageway through the outlet further comprises injecting a fluid slurry containing gravel through the first and second slurry passageways such that the fluid slurry exits the first and second slurry passageways through first and second outlets, the first and second outlets being at different axial positions along the outer tubular.

64. The method as recited in claim 49 wherein injecting a fluid slurry containing gravel through the slurry passageway further comprises injecting a fluid slurry containing gravel through first, second, third and fourth slurry passageways.

65. The method as recited in claim 64 wherein the step of injecting a fluid slurry containing gravel through the slurry passageway such that the fluid slurry exits the slurry passageway through the outlet further comprises injecting a fluid slurry containing gravel through the first, second, third and fourth slurry passageways such that the fluid slurry exits the first, second, third and fourth slurry passageways through first, second, third and fourth outlets, the first, second, third and fourth outlets being at different axial positions along the outer tubular.

66. A method for gravel packing an interval of a wellbore, the method comprising the steps of:

providing a casing within the wellbore traversing a formation;

perforating the casing proximate the formation to form a plurality of perforations;

locating a sand control screen within the wellbore proximate the formation;

positioning a gravel packing apparatus around the sand control screen to form a first annulus between the gravel packing apparatus and the wellbore, the gravel packing apparatus comprising an outer tubular and an inner tubular disposed within the outer tubular forming a second annulus therebetween, the second annulus including an axially extending slurry passageway and an axially extending production pathway, the slurry passageway being in fluid isolation from the production pathway;

injecting a fluid slurry containing gravel through the slurry passageway such that the fluid slurry exits the slurry passageway through an outlet leaving a first portion of the gravel in the first annulus then enters openings in the outer tubular leaving a second portion of the gravel in the production pathway; and terminating the injecting.

67. The method as recited in claim 66 further comprising the step of actuating a device disposed within the outlet to selectively allow and prevent the flow of the fluid slurry therethrough.

68. The method as recited in claim 66 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through an exit tube disposed within the outlet to increase the pressure drop of the fluid slurry traveling therethrough.

69. The method as recited in claim 66 further comprising the step of positioning an insert member at least partially in the outlet, the insert member comprising an erosion-resistant material.

70. The method as recited in claim 66 further comprising the step of disposing an isolation member within the second annulus to define the slurry passageway and the production pathway and to prevent fluid communication therebetween.

71. The method as recited in claim 70 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

72. The method as recited in claim 66 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through two outlets.

73. The method as recited in claim 72 further comprising the step of sizing one of the two outlets a first size and sizing the other of the two outlets a second size.

74. The method as recited in claim 66 wherein injecting a fluid slurry containing gravel through the slurry passageway further comprises injecting a fluid slurry containing gravel through first and second slurry passageways and wherein leaving a second portion of the gravel in the production pathway further comprises leaving a second portion of the gravel in first and second production pathways.

75. The method as recited in claim 74 wherein the step of injecting a fluid slurry containing gravel through the slurry passageway such that the fluid slurry exits the slurry passageway through the outlet further comprises injecting a fluid slurry containing gravel through the first and second slurry passageways such that the fluid slurry exits the first and second slurry passageways through first and second outlets, the first and second outlets being at different axial positions along the outer tubular.

76. The method as recited in claim 66 wherein injecting a fluid slurry containing gravel through the slurry passageway further comprises injecting a fluid slurry containing gravel through first, second, third and fourth slurry passageways and wherein leaving a second portion of the gravel in the production pathway further comprises leaving a second portion of the gravel in first, second, third and fourth production pathways.

77. The method as recited in claim 76 wherein the step of injecting a fluid slurry containing gravel through the slurry passageway such that the fluid slurry exits the slurry passageway through the outlet further comprises injecting a fluid slurry containing gravel through the first, second, third and fourth slurry passageways such that the fluid slurry exits the first, second, third and fourth slurry passageways through first, second, third and fourth outlets, the first, second, third and fourth outlets being at different axial positions along the outer tubular.

78. A method for gravel packing an interval of a wellbore, the method comprising the steps of:

traversing a formation with the wellbore;

locating a sand control screen within the wellbore proximate the formation;

positioning a gravel packing apparatus around the sand control screen to form a first annulus between the gravel packing apparatus and the wellbore, the gravel packing apparatus comprising an outer tubular and an inner tubular disposed within the outer tubular forming a second annulus therebetween, the second annulus including an axially extending slurry passageway and an axially extending production pathway, the slurry passageway being in fluid isolation from the production pathway;

injecting a fluid slurry containing gravel through the first annulus and the slurry passageway such that the fluid slurry in the slurry passageway exits through an outlet into the first annulus;

depositing a first portion of the gravel in the first annulus;

depositing a second portion of the gravel in the production pathway by injecting a portion of the fluid slurry through openings in the outer tubular; and terminating the injecting.

79. The method as recited in claim 78 further comprising the step of actuating a device disposed within the outlet to selectively allow and prevent the flow of the fluid slurry therethrough.

80. The method as recited in claim 79 wherein the step of actuating a device further comprises actuating a pressure actuated device.

81. The method as recited in claim 79 wherein the step of actuating a device further comprises actuating a valve.

82. The method as recited in claim 79 wherein the step of actuating a device further comprises actuating a rupture disk.

83. The method as recited in claim 78 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through an exit tube disposed within the outlet to increase the pressure drop of the fluid slurry traveling therethrough.

84. The method as recited in claim 83 wherein at least a portion of the exit tube is disposed within the first annulus.

85. The method as recited in claim 83 wherein at least a portion of the exit tube is disposed within of the second annulus.

86. The method as recited in claim 78 further comprising the step of positioning an insert member at least partially in the outlet, the insert member comprising an erosion-resistant material.

87. The method as recited in claim 78 further comprising the step of disposing an isolation member within the second annulus to define the slurry passageway and the production pathway and to prevent fluid communication therebetween.

88. The method as recited in claim 87 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

89. The method as recited in claim 78 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through two outlets.

90. The method as recited in claim 89 further comprising the step of sizing one of the two outlets a first size and sizing the other of the two outlets a second size.

91. The method as recited in claim 78 wherein injecting a fluid slurry containing gravel through the slurry passageway further comprises injecting a fluid slurry containing gravel through first and second slurry passageways and wherein depositing a second portion of the gravel in the production pathway further comprises depositing a second portion of the gravel in first and second production pathways.

92. The method as recited in claim 91 wherein the step of injecting a fluid slurry containing gravel through the slurry passageway such that the fluid slurry exits the slurry passageway through the outlet further comprises injecting a fluid slurry containing gravel through the first and second slurry passageways such that the fluid slurry exits the first and second slurry passageways through first and second outlets, the first and second outlets being at different axial positions along the outer tubular.

93. The method as recited in claim 78 wherein injecting a fluid slurry containing gravel through the slurry passageway further comprises injecting a fluid slurry containing gravel through first, second, third and fourth slurry passageways and wherein depositing a second portion of the gravel in the production pathway further comprises depositing a second portion of the gravel in first, second, third and fourth production pathways.

94. The method as recited in claim 93 wherein the step of injecting a fluid slurry containing gravel through the slurry passageway such that the fluid slurry exits the slurry passageway through the outlet further comprises injecting a fluid slurry containing gravel through the first, second, third and fourth slurry passageway such that the fluid slurry exits the first, second, third and fourth slurry passageways through first, second, third and fourth outlets, the first, second, third and fourth outlets being at different axial positions along the outer tubular.

95. A method for gravel packing an interval of a wellbore, the method comprising the steps of:

providing a casing within the wellbore traversing a formation;

perforating the casing proximate the formation to form a plurality of perforations;

locating a sand control screen within the wellbore proximate the formation;

positioning a gravel packing apparatus around the sand control screen to form a first annulus between the gravel packing apparatus and the wellbore, the gravel packing apparatus comprising an outer tubular and an inner tubular disposed within the outer tubular forming a second annulus therebetween, the second annulus including an axially extending slurry passageway and an axially extending production pathway, the slurry passageway being in fluid isolation from the production pathway;

injecting a fluid slurry containing gravel through the first annulus and the slurry passageway such that the fluid slurry in the slurry passageway exits through an outlet into the first annulus;

depositing a first portion of the gravel in the first annulus;

depositing a second portion of the gravel in the production pathway by injecting a portion of the fluid slurry through openings in the outer tubular; and terminating the injecting.

96. The method as recited in claim 95 further comprising the step of actuating a device disposed within the outlet to selectively allow and prevent the flow of the fluid slurry therethrough.

97. The method as recited in claim 95 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through an exit tube disposed within the outlet to increase the pressure drop of the fluid slurry traveling therethrough.

98. The method as recited in claim 95 further comprising the step of positioning an insert member at least partially in the outlet, the insert member comprising an erosion-resistant material.

99. The method as recited in claim 95 further comprising the step of disposing an isolation member within the second annulus to define the slurry passageway and the production pathway and to prevent fluid communication therebetween.

100. The method as recited in claim 99 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

101. The method as recited in claim 95 wherein the step of injecting a fluid slurry containing gravel through the slurry passageway such that the fluid slurry exits the slurry passageway through the outlet further comprises injecting a fluid slurry containing gravel through the slurry passageway such that the fluid slurry exits the slurry passageway through two outlets.

102. The method as recited in claim 101 further comprising the step of sizing one of the two outlets a first size and sizing the other of the two outlets a second size.

103. The method as recited in claim 95 wherein injecting a fluid slurry containing gravel through the slurry passageway further comprises injecting a fluid slurry containing gravel through first and second slurry passageways and wherein depositing a second portion of the gravel in the production pathway further comprises depositing a second portion of the gravel in first and second production pathways.

104. The method as recited in claim 103 wherein the step of injecting a fluid slurry containing gravel through the slurry passageway such that the fluid slurry exits the slurry passageway through the outlet further comprises injecting a fluid slurry containing gravel through the first and second slurry passageways such that the fluid slurry exits the first and second slurry passageways through first and second outlets, the first and second outlets being at different axial positions along the outer tubular.

105. The method as recited in claim 95 wherein injecting a fluid slurry containing gravel through the slurry passageway further comprises injecting a fluid slurry containing gravel through first, second, third and fourth slurry passageways and wherein depositing a second portion of the gravel in the production pathway further comprises depositing a second portion of the gravel in first, second, third and fourth production pathways.

106. The method as recited in claim 105 wherein the step of injecting a fluid slurry containing gravel through the slurry passageway such that the fluid slurry exits the slurry passageway through the outlet further comprises injecting a fluid slurry containing gravel through the first, second, third and fourth slurry passageway such that the fluid slurry exits the first, second, third and fourth slurry passageways through first, second, third and fourth outlets, the first, second, third and fourth outlets being at different axial positions along the outer tubular.

* * * * *